United States Patent [19]

Johnson

[11] 4,418,378

[45] Nov. 29, 1983

[54] LIGHT BOX

[75] Inventor: Sigurd A. Johnson, Glendora, Calif.

[73] Assignee: Plan Hold Corporation, Irvine, Calif.

[21] Appl. No.: 240,851

[22] Filed: Mar. 5, 1981

[51] Int. Cl.[3] ..... G09F 13/04

[52] U.S. Cl. ..... 362/97; 362/223; 362/248; 362/291; 362/311; 362/343; 362/354

[58] Field of Search ..... 362/97, 217, 223, 248, 362/290, 291, 293, 311, 317, 342, 343, 354, 355

[56] References Cited

U.S. PATENT DOCUMENTS 3,348,039 10/1967 Schrage ..... 362/223
4,335,421 6/1982 Modia ..... 362/223

FOREIGN PATENT DOCUMENTS 1312499 11/1961 France ..... 362/223

*Primary Examiner*—Donald P. Walsh

*Attorney, Agent, or Firm*—Roms, Smith, Lande & Rose

[57] ABSTRACT

A light box having one or more fluorescent light source tubes provided with light diffusing and mixing members of tubular form for modifying the light emitted by the fluorescent light tubes to provide a substantially uniformly illuminated backlighted work surface for use in tracing, stripping art work, and viewing color slides, photo negatives, and X-rays. The light box includes internal coated reflective surfaces on bottom and side walls. The light diffusing and mixing member includes light reflective interior and exterior coatings, shaped end portions and in one example perforations providing light transmitting openings. A light diffusing and mixing member of selected light translucent material having shaped end portions and arranged in accordance with the intensity of light emanating from the tubular fluorescent light source.

10 Claims, 8 Drawing Figures

LIGHT BOX

BACKGROUND OF THE INVENTION

This invention relates to a light box and to means for providing substantially uniform illumination of a selected work area for use ingraphic arts.

Prior proposed light boxes or illuminated work areas have included different forms of construction in the arrangement of the light source, the interior of the light box, and the top plate-like member providing the backlighted working area. In such prior proposed light box constructions, light sources have included incadescent lamps and fluorescent tubes. Incandescent lamps generated substantial heat which often required cooling means so that the work surface would not become too hot. Prior incandescent lamps were essentially point light sources and uniformity of illumination of the work surface was difficult to achieve. Fluorescent tubes were cooler and did not require the cooling means of the incandescent light sources, but provided an elongated light source in which the intensity of light emanating along the length of the fluorescent tube was nonuniform. In prior proposed light box constructions using fluorescent tubes, various reflective means were used to modify and redistribute the light emanating from the tubes, such modifying means being usually in the form of irregular configurations of the reflective surfaces of the interior walls of the light box, by the use of various forms of baffles supported from the light box, and the use of slits or regulated openings in baffles to redistribute the light.

It is believed that the intensity of illumination in footcandles of such a working illuminated surface area is preferably in the range of between 300 to 400 footcandles. Within this range of illumination, it is desired that the difference in intensity of illumination throughout incremental areas of the working surface be minimized as much as possible so that, for example, the intensity of illumination over the enire working surface may vary, for example, from 350 footcandles plus or minus 15 footcandles. It is also recognized that the extreme marginal or peripheral areas of the working surface may be illuminated with slightly less intensity of light without being objectionable to the user of the light box because most of the work is performed in the remaining work area.

Some prior proposed light box constructions in current use have been measured for uniformity of illumination. Over the working area, variation of intensity of illumination was found to be in the order of 50 to 70 footcandles and in one construction the contour or shape of the lines of the same light intensity were found to be unsymmetrical and light intensity was in a range of from 150 footcandles near the periphery to 270 footcandles adjacent the center of the working area.

SUMMARY OF INVENTION

The present invention relates to a light box having elongated fluorescent light source tubes and a light diffusing and mixing member sleeved over each tube and shaped to provide mixing and redistribution of light beams reflected from the light diffusing member and the interior surfaces of the light box so as to provide substantially uniform illumination of the working surface of the box.

The main object of the present invention, therefore, is to disclose a light box provided with a backlighted working surface in which the intensity of illumination of said surface is substantially uniform throughout its entire area.

An object of the invention is to provide a light box of simple economic effective construction with light reflective interior bottom and side wall surfaces which cooperate with a light diffusing and light mixing member carried by tubular light sources to provide such uniformity of illumination of a working surface.

An object of the invention is to disclose a novel shape and form of a light diffusing and mixing member for use in such a light box mentioned above.

Another object of the invention is to provide a light diffusing and mixing member which is shaped in relation to the variation in intensity of light emitted from the light source.

A further object of the invention is to disclose a light mixing and diffusing member in which light reflective coatings are provided both interiorly and exteriorly of the member and in which the member is provided with aggregate perforations of a preselected area.

A still further object of the invention is to provide a light diffusing and mixing member which is so shaped and is provided with selected translucency that uniform illumination of the working surface is achieved in cooperation with the internal light reflecting surfaces of a rectangular light box having planar 90° internal reflective surfaces.

A still further object of the invention is to disclose a light diffusing and mixing member in which a plurality of light openings are provided, the aggregate area of said openings being in the order of approximately 40% of the aggregate area of the mixing member.

Various other objects and advantages of the present invention will be readily apparent from the following description of the drawings in which exemplary embodiments of the invention are shown.

Figure 1:
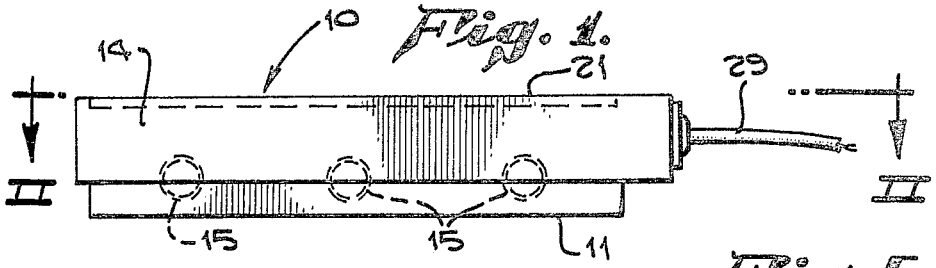
FIG. 1 is an elevational view of a light box embodying this invention.
Figure 2:
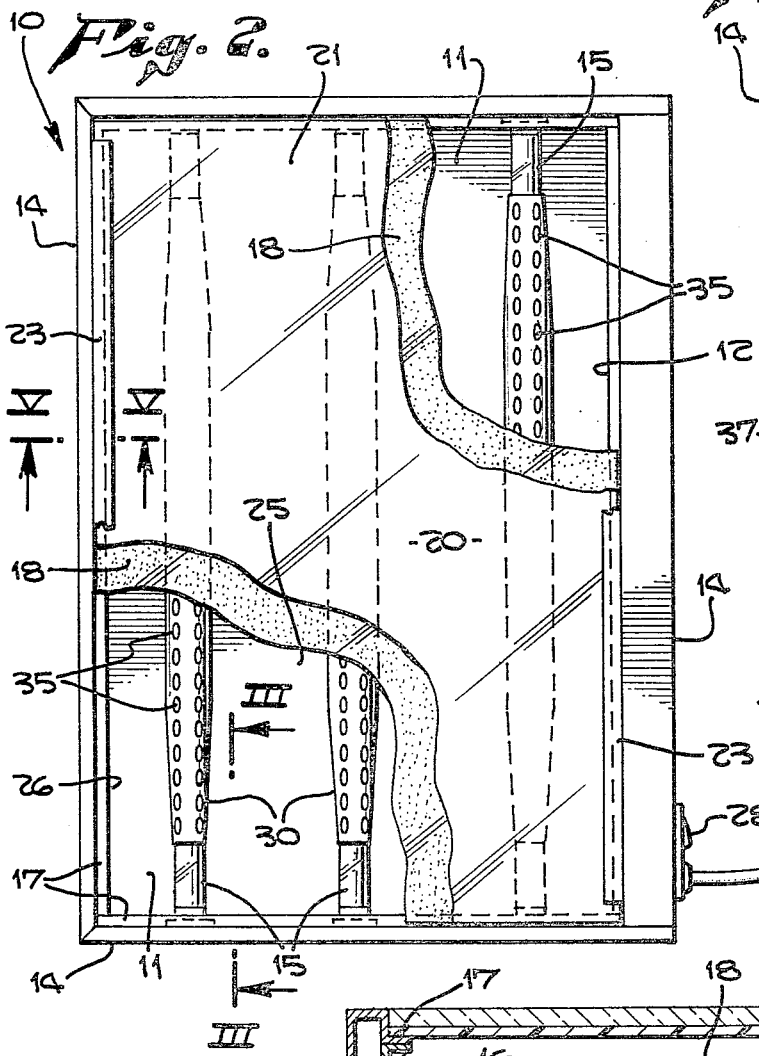
FIG. 2 is a top plan view of the box shown in FIG. 1, the top wall of the box being broken away in two areas to show fluorescent tubes and light mixing and diffusing members thereon.
Figure 5:
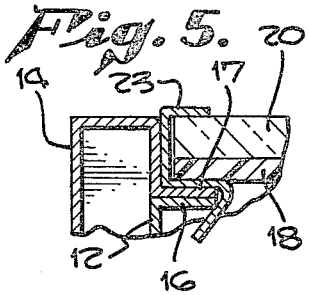
FIG. 5 is an enlarged fragmentary sectional view taken in the vertical plane indicated by line V—V of FIG. 2.
Figure 4:
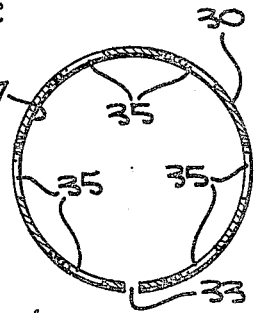
FIG. 4 is a vertical transverse sectional view taken in the plane indicated by line IV—IV of FIG. 3, the fluorescent tubular light source being omitted.
Figure 3:
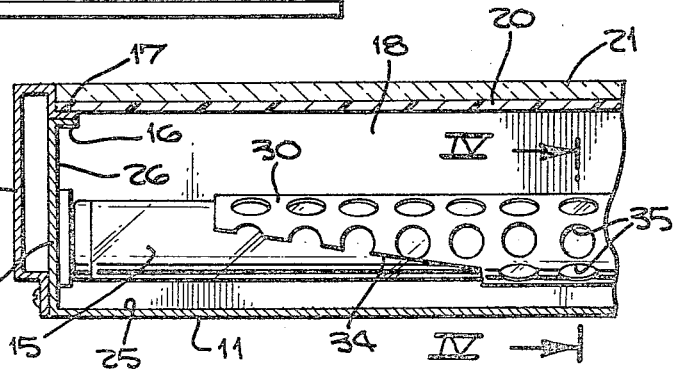
FIG. 3 is an enlarged fragmentary sectional view taken in the vertical plane indicated by line III—III of FIG. 2.
Figure 8:
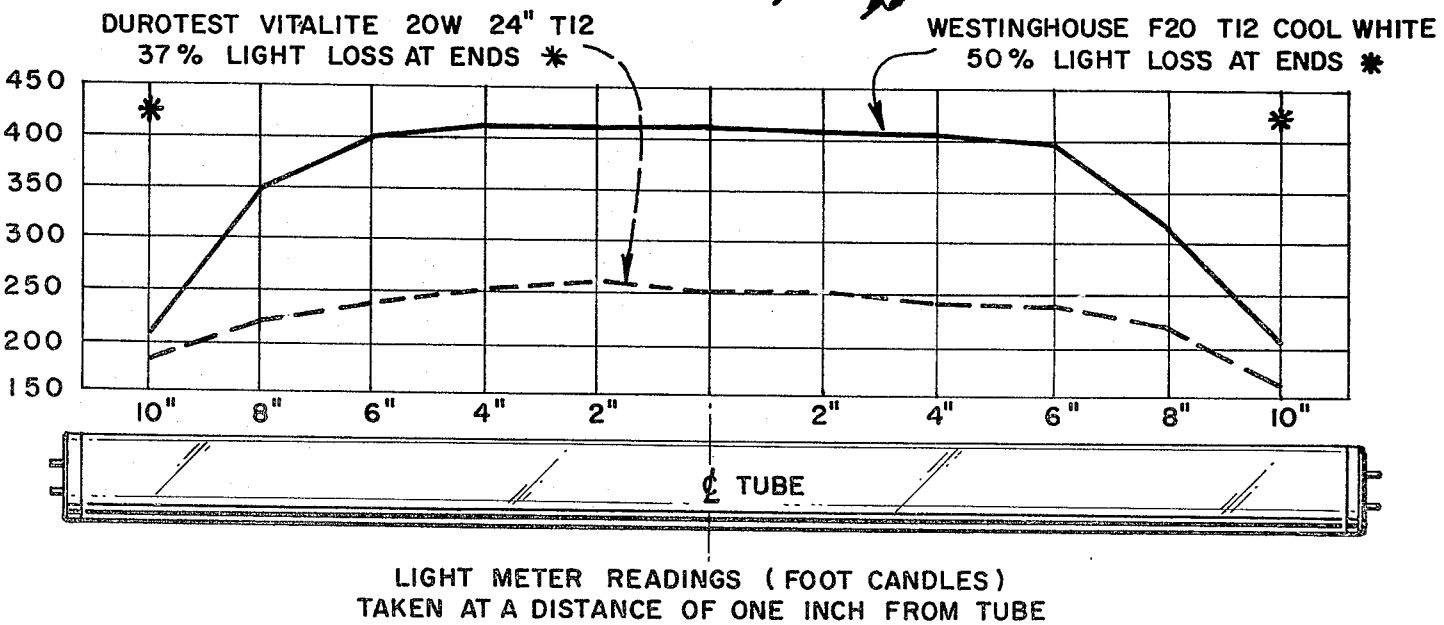

FIG. 8 is a chart illustrating variations in light intensity of two different typed of fluorescent tubes and illustrating the variation in light intensity along the length of such a tube. In detail, a light box 10 embodying this invention may include a rectangular receptacle have a rectangular, planar bottom wall 11 with upstanding peripheral side walls 12 providing an open top receptacle. External peripheral side walls 14 may be suitably spaced from side walls 12 to provide peripheral space acting as conduits for electrical wire and ballast means associated with elongated fluorescent tubes 15 and other wiring accessories. The internal peripheral side walls 12 are provided with an inturned top edge 16 cooperable with an internal recessed flange 17 provided on the external peripheral side wall 14 to provide a peripheral seat or shelf for supporting a translucent light diffusing plate 18. Resting on top of plate 18 and of the same shape and configuration may be a transparent plate glass member 20 providing a top working surface 21. A suitable clip 23 (FIG. 5) may be used at selected spaced intervals around the periphery of plates 18 and 20 to releasably secure the plates on the marginal seat provided by flange 17.

Internal surfaces 25 of the bottom wall 11 and 26 of the peripheral side walls 12 may be coated with a suitable light reflective coating such as white paint or enamel or any other coating having high light reflective characteristics.

Light diffusing plate 18 may be made of a suitable plastic material such as an acrylite, Plexiglas, or other suitable light translucent material which has the characteristic of diffusing light transmitted therethrough. The plate glass member 20 provides a hard working surface 21 and not only transmits diffused light emanating from the diffusing plate 18, but also provides a working surface which is not readily marred or damaged by use of tracing or other instruments.

Fluorescent light tubes 15 may be standard cool white fluorescent tubes such as the Westinghouse F20T12 cool white or a Durotest Vitalite 20W 24" T12. In some instances where critical color rendition is a factor as in viewing photographic transparencies, color corrected fluorescent tubes may be used such as those color corrected to 5500° Kelvin. In the present example of this invention, three fluorescent tubes are used in light box 10 uniformly spaced from each other and mounted on the side walls 12 in usual manner. Such tubes have the usual electrical connection to a switch means 28 which is connected to a power source through lead 29.

In the first example of this invention, each tube 15 is provided with a light diffusing and mixing member 30. Light mixing member 30 may be made of metal or of a high impact white polystyrene. Mixing member 30 comprises an elongated central cylindrical portion 32 provided with a longitudinal slit and opening 33 to permit suitable radial expansion of the member 30 when being installed on a tube 15. Each end portion 34 of member 30 may be truncated at an angle of approximately 10° to 20°. The length of each mixing member 30 is slightly less than the length of fluorescent tube 15. When tube 30 is sleeved over a tube 15 and equipositioned from each end of tube 15, member 30 may be rotated so that the truncated end portions face downwardly towards the bottom wall 11 of the receptacle. The mixing member 30 is also provided with a plurality of longitudinally and circumferentially spaced light perforations or openings 35 which directly transmit light from the fluorescent tube 15. Internal surfaces 37 and external surfaces 38 of mixing member 30 are coated with a white light reflectant material such as suitable paint or enamel. The aggregate area of openings 35 in a mixing member 30 may be in the order of 35% to 60% of the total surface area of the mixing member 30.

The aggregate area of the openings 35 in the mixing member 30 and the length of the truncated end portions 34 are related to the variance in intensity of light emanating from fluorescent tube 15, such variations being schematically illustrated in FIG. 8. In FIG. 8 it will be noticed that one type of Westinghouse tube of approximately 24" in length varies from slightly more than 200 footcandles at the ends of the tube to approximately 400 footcandles at 6" from the ends of the tube. Thus, there was an approximately 50% light loss over the 4" end portion of this fluorescent tube. The intensity of illumination at the center of the tube was approximately 410 footcandles and illumination was generally uniform between 6" on each side of the center of the tube.

In another type of tube tested; that is, the Durotest tube, FIG. 8, the intensity of illumination varied somewhat differently, the intensity at the ends of the tube being approximately 180 footcandles at one end and 160 footcandles at the other end. At 6" from the center of the tube, the intensity of illumination was at one 6" point 250 footcandles and at the other 6" point approximately 240 footcandles. The intensity of illumination at the center of the tube is approximately 250 footcandles. Thus, in the Durotest fluorescent tube there was measured approximately a 37% light loss at the end portion of the tube.

The light diffusing and mixing member 30 with its truncated end portions 34 permits more light to emanate from end portions of tube 15 so that the extreme light losses at ends of the tube, as indicated in FIG. 8, are substantially compensated for. In further explanation of the substantially uniform illumination of the working surface 21 provided by the light mixing and diffusing member 30 of this invention, it will be understood that light emitted by fluorescent tube 15 at the end portions of member 30 will be thus obstructed by the truncated end portions and light from the adjacent tube end portion will be directed downwardly to the light reflective surface 25 of the bottom wall throughout a plurality of radial angles and reflected by surface 25 to interior reflective surfaces 26 of the peripheral side walls and then to the diffusing plate 18 and through the plate glass 20. The truncated end portions 34, which include light reflective internal and external surfaces, further diffuses and mixes the light emitted from tube 15 underneath the truncated end portion 34. Internal reflective surface 37 reflects light toward the tube where it is further diffused and is ultimately directed downwardly or radially outwardly through openings 35 provided in end portion 34. Light emanating through openings 35 is partially reflected off the inner surface of diffusing plate 18 and if such reflected light impinges upon external surfaces 38 of portion 34, such beams of light will again be reflected toward the reflective surfaces 26 or the diffusing plate 18.

In the central portion of tube 15 which is enclosed by member 30, light is internally reflected from reflective surfaces 37 of member 30, is transmitted through openings 35 in several radial directions towards diffusing plate 18 and reflective surfaces on side walls 26 and bottom wall 25, and is further reflected until reflected mixed light beams ultimately pass through diffusing plate 18 and plate glass 20 for illuminatation of the working surface 21. Measurement of illumination of working surface 21 when perforated light diffusing and mixing members 30 are installed on the fluorescent tubes 15 has indicated a range for a cool white tube to be from about 325 footcandles closely adjacent to the periphery of the working area to 345 footcandles at a point close to the center of the working area. These measurements were taken with a 16 lb. drafting velum on the working surface area 21, the diffused light passing through the velum before measurement.

Light intensity readings taken without a velum on the working surface 21 and employing a cool white fluorescent tube and diffuser plate of Plexiglas showed intensity of illumination at peripheral margins of about 400 footcandles and at the center of the working area about 415 footcandles. In a test wherein the fluorescent tubes were color corrected to 5000° Kelvin and light readings were taken through the glass surface only, the variation at the periphery to the center of the working area ranged from 375 to 390 footcandles. In another test using a tube color corrected to 5500° Kelvin and taking intensity readings through the glass surface only, the variation in footcandles between the peripheral margins and the center of the working area was 300 to 312.

It will thus be readily apparent to those skilled in the art that the use of a light diffusing and mixing member of the type shown in the first embodiment of this invention achieves substantial uniformity of illumination of a backlighted working surface.

Figure 7:
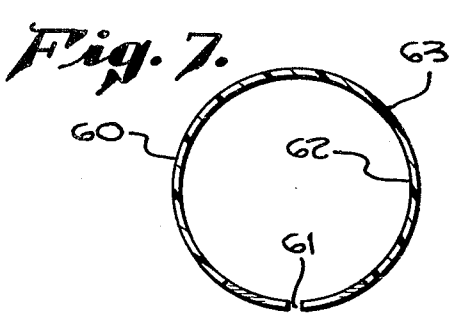
FIG. 7 is a sectional view taken in the plane indicated by line VII—VII of FIG. 6.
Figure 6:
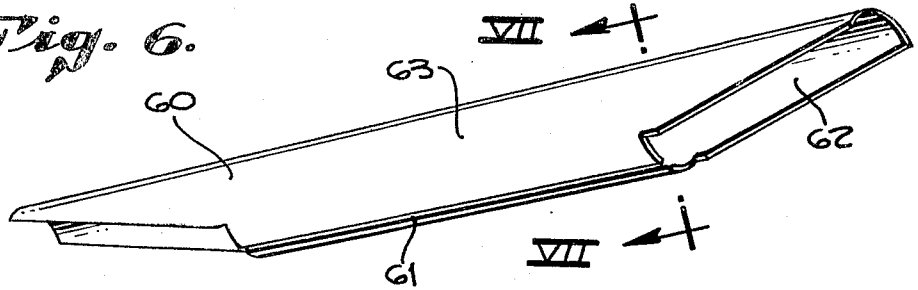
FIG. 6 is a perspective view of a different embodiment of the light mixing and diffusing member employed in this invention.

In FIGS. 6 and 7, a modification of the invention is shown in which a light diffusing and mixing member 60 is made of a nonperforated sleeve. In FIGS. 6 and 7 light diffusing and mixing member 60 is shown of similar shape as that of the prior example. The walls of mixing member 60 are nonperforated and may be made of suitable light translucent material including paper or a plastic material. In this example, the invention contemplates extruding a plastic tube while controlling the amount of pigments introduced into the plastic mix to provide a preselected amount of light transmission and color quality when member 60 placed on a fluorescent tube light source. In the event the light mixing and diffusing member 60 is made of suitable light translucent paper, the paper may be varied in density or light transmission over its length to provide a selected emission of light from the tube and mixing member. When such modified light emanates from the tube and mixing member 60, the reflection of such light ultimately reaches the light diffusing plate 18 and light illuminating working surface 21 would be substantially uniform; that is, within the narrow range of differences in footcandles, as indicated above in the prior example. It will be understood that light diffusing amd mixing member 60 may be provided with a longitudinal slit 61 and internal and external light reflecting surfaces 62 and 63 while at the time permitting some light transmission therethrough.

It will be understood that various modifications and changes may be made in the shape, reflectivity, translucency, and material of the light diffusing and mixing member which may come within the spirit of this invention in order to provide a light modifying means for the light emanating from an elongated tubular light source, and all such changes and modifications coming within the scope of the appended claims are embraced thereby.

I claim:

1. A light intensity modifying means for an elongated tubular light emitting source comprising:

a tubular cylindrical member of sheet material having means for transmitting selected amounts of light therethrough along its length, having a central portion of substantially cylindrical shape transmitting a selected amount of light and adapted to be sleeved over the central cylindrical portion of said tubular light source, said light transmitting means providing progressively increased amounts of light to the ends of the tubular member with respect to the amount of light transmitted at the central portion of said tubular member, and whereby the amount of light emitted by said source and transmitted by said tubular member is reduced at said central portion and the amount of light transmitted at said end portions is progressively increased with respect to the reduced amount of light at said central portion to provide substantially uniform illumination.

2. A light means as stated in claim 1 wherein said sheet material is opaque, said means for transmitting light includes light transmitting openings of selected area throughout the length of the tubular member to compensate for variations in intensity of light emitted by said light source.

3. A light means as stated in claim 1 wherein said end portions are of truncated form and are at an angle to the axis, of said tubular member for transmitting light in proportion with the loss of light intensity at ends of the tubular light emitting source.

4. A light means as stated in claim 2 wherein said surfaces of sheet material facing said light source have a light reflective coating.

5. A light means as stated in claim 1 wherein said sheet material is translucent.

6. A light means as stated in claim 5 wherein said translucent sheet material is provided with varying pigmentation in its composition to provide a predetermined light transmission therethrough when sleeved over an elongated light emitting source.

7. A light means as stated in claim 1 including sixty to thirty-five percent of the total surface area of said tubular light emitting source is covered by said tubular member of sheet material.

8. In a light box having one or more flourescent light source tubes of selected length and provided with light reflecting internal surfaces and a light transmitting wall providing a working surface to be illuminated, the provision of:

a light diffusing and mixing member of hollow tubular cylindrical form having a central cylindrical portion and having end sections of truncated shape;

said light mixing member having means along its length for transmitting selected amounts of light from said light source tube;

each truncated end section being formed by a plane disposed at an angle to the axis of the cylindrical member of about 10 to 20 degrees, each end section terminating in spaced relation to the adjacent end of the light source tube;

said cylindrical light mixing member being positionable on said light source tube with said truncated end sections covering the surface of the light source tube nearest the light transmitting wall and internal faces of said end sections facing the reflecting surfaces of said box opposite said light transmitting wall, whereby light emitted along the length of the light source tube is transmitted by said central portion in reduced amount and said light transmitted at said end sections is partially reduced in accordance with variations of light intensity along the length of said light source tube to provide mixed reflected light for substantially uniform illumination of said light transmitting wall and said working surface.

9. In a light box as stated in claim 8 wherein said light mixing member is of opaque sheet material; and said means for transmitting light includes thru openings of selected area in said opaque material.

10. In a light box as stated in claim 8 wherein said means for transmitting light in said light mixing member includes means for varying light transmitting characteristics of said sheet material.

* * * * *